US011325755B2

(12) United States Patent
Crosby

(10) Patent No.: US 11,325,755 B2
(45) Date of Patent: May 10, 2022

(54) POURING SPOUT FITMENT FOR FLEXIBLE CONTAINER

(71) Applicant: GBS Holdings LLC, Oak Ridge, TN (US)

(72) Inventor: Bryan Justin Robert Crosby, Knoxville, TN (US)

(73) Assignee: GBS HOLDINGS LLC, Oak Ridge, TN (US)

( * ) Notice: Subject to any disclaimer, the term of this patent is extended or adjusted under 35 U.S.C. 154(b) by 53 days.

(21) Appl. No.: 16/768,476

(22) PCT Filed: Nov. 30, 2018

(86) PCT No.: PCT/US2018/063195

§ 371 (c)(1),
(2) Date: May 29, 2020

(87) PCT Pub. No.: WO2019/108870

PCT Pub. Date: Jun. 6, 2019

(65) Prior Publication Data

US 2021/0171245 A1 Jun. 10, 2021

Related U.S. Application Data

(60) Provisional application No. 62/593,288, filed on Dec. 1, 2017.

(51) Int. Cl.
*B65D 47/06* (2006.01)
*B65D 47/08* (2006.01)
(Continued)

(52) U.S. Cl.
CPC ..... *B65D 47/063* (2013.01); *B65D 47/088* (2013.01); *B65D 47/122* (2013.01);
(Continued)

(58) Field of Classification Search
CPC ..... B65D 47/063; B65D 47/0838; B65D 47/122; B65D 75/5877; B65D 25/48; B65D 47/61; B65D 25/46
(Continued)

(56) References Cited

U.S. PATENT DOCUMENTS 1,473,925 A * 11/1923 Dryer ..... B65D 47/061 222/523
4,452,382 A 6/1984 Von Holdt
(Continued)

FOREIGN PATENT DOCUMENTS

| | | | |
|---|---|---|---|
| JP | H11 255 250 | A | 9/1999 |
| KR | 20040038973 | A | 5/2004 |
| WO | 9008074 | A1 | 7/1990 |

OTHER PUBLICATIONS

International Search Report and Written Opinion, PCT/US2018/063195, dated Mar. 11, 2019 (16 pp.).

*Primary Examiner* — Jeremy Carroll
(74) *Attorney, Agent, or Firm* — Eversheds Sutherland (US) LLP

(57) ABSTRACT

Flexible package fitments for use with detachable dispensing systems are provided. Pouring spout fitments configured to be attached to the inner surface of flexible containers are also provided. The detachable dispensing systems and pouring spout fitments include a hollow rigid member (115) and an extendible spout (121) disposed within and at least partially attached to the hollow rigid member and selectively positionable between a recessed position and, alternatively, an extended position, in which the extendible spout is configured to dispense a pourable material from the container through a distal opening when the fitment is attached to a flexible package. Material containers are also provided that include the fitments described herein.

16 Claims, 14 Drawing Sheets

(51) Int. Cl.
*B65D 47/12* (2006.01)
*B65D 75/58* (2006.01)

(52) U.S. Cl.
CPC ..... *B65D 75/5877* (2013.01); *B65D 75/5883* (2013.01); *B65D 2575/586* (2013.01)

(58) Field of Classification Search
USPC ..... 222/530, 538, 539, 537
See application file for complete search history.

(56) References Cited

U.S. PATENT DOCUMENTS

| | | | | | |
|---|---|---|---|---|---|
| 5,088,632 | A * | 2/1992 | Odet | B65D 47/063 | 222/529 |
| 5,607,086 | A * | 3/1997 | Gooch | B65D 47/061 | 222/525 |
| 6,112,949 | A * | 9/2000 | Rhodes | B65D 47/061 | 222/153.02 |
| 6,364,179 | B1 * | 4/2002 | Sullivan | B67D 3/04 | 222/130 |
| 7,624,899 | B1 * | 12/2009 | Barksdale | B65D 51/18 | 215/43 |
| 9,056,699 | B2 * | 6/2015 | Crosby | B65D 47/0885 | |
| 9,550,606 | B2 | 1/2017 | Crosby | | |
| 10,112,746 | B2 * | 10/2018 | Crosby | B65D 25/48 | |
| 10,589,908 | B2 | 3/2020 | Crosby | | |
| 2013/0270307 | A1 * | 10/2013 | Crosby | B65D 51/20 | 222/530 |
| 2016/0272371 | A1 * | 9/2016 | Crosby | B65D 47/0885 | |
| 2017/0088317 | A1 * | 3/2017 | Crosby | B65D 47/063 | |

* cited by examiner

POURING SPOUT FITMENT FOR FLEXIBLE CONTAINER

CROSS-REFERENCE TO RELATED APPLICATIONS

This application claims the benefit of priority to U.S. Provisional Patent Application No. 62/593,288, filed Dec. 1, 2017, which is incorporated by reference herein in its entirety.

TECHNICAL FIELD

The present disclosure relates generally to dispensing systems, more particularly, to pouring spout fitments for flexible containers.

BACKGROUND

Typically, when transferring fluids from a container, it is necessary either to attach a pouring spout to the container or to insert a funnel into the receiving vessel to prevent unwanted spillage. Such transfer methods are commonly used to deliver fluids such as motor oil, antifreeze, transmission fluid, and gasoline additives to an automobile. A common problem when using transfer devices such as a pouring spout or a funnel to transfer such fluids is that a user must locate, clean, and dry the transfer device to avoid contamination of the fluid during transfer to the receiving vessel. The user must also select a transfer device of an appropriate size and shape to enable the transfer of fluids without spillage.

Flexible containers closed with a fitment and lid are considered particularly advantageous forms of packaging for fluids such as motor oil, antifreeze, transmission fluid, and gasoline, because they are lighter than their rigid counterparts, and produce a smaller volume of waste once the empty container is disposed by a consumer. Additionally, flexible containers advantageously allow a user to empty more of a viscous fluid from the flexible container than from a rigid container. However, it can be particularly difficult for consumers to open and dispense from flexible containers. For example, users often spill the contents of flexible containers while opening them, or while dispensing them, because the pressure of a user's grip on the flexible container during these activities can cause unintended flow of the fluid within the flexible package through the package opening and out of the package.

Accordingly, there is a need for an improved fitment and pouring spout for flexible containers to facilitate the easy and clean transfer of pourable materials from flexible containers.

SUMMARY

In one aspect, dispensing systems for containers are provided. In one embodiment, a dispensing system is provided including: a hollow rigid member comprising top end having a discharge opening and a base end; an extendible spout at least partially disposed in the hollow rigid member and connected to the hollow rigid member, the extendible spout comprising: a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the container through the distal opening when the dispensing system is attached to the inner surface of the flexible container; and a removable lid which is selectively positionable between a closed position, wherein the removable lid covers the discharge opening of the hollow rigid member and the distal opening of the extendible spout and an open position, wherein the removable lid allows a pourable material to pass through the discharge opening of the hollow rigid member and the distal opening of the extendible spout, wherein the removable lid further comprises: a first sealing flange which engages with the top end of the hollow member to form a seal between the removable lid in the closed position and the hollow member; and a second sealing flange which engages with the distal end of the extendible spout to form a seal between the removable lid in the closed position and the extendible spout.

In another embodiment, a pouring spout fitment for a flexible container including: (1) a hollow canoe portion having an outer surface and an inner surface defining a passage extending through the body, wherein the canoe is configured to be attached to an inner surface of the flexible container; (2) a hollow rigid member at least partially disposed within the hollow canoe portion, the hollow rigid member comprising a top end having a discharge opening and a base end, the base end extending from the hollow canoe portion toward the flexible container; (3) an extendible spout at least partially disposed in the hollow rigid member and connected to the hollow rigid member, the extendible spout comprising: a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the flexible container through the distal opening when the hollow canoe portion is attached to the inner surface of the flexible container; and (4) a removable lid which is selectively positionable between a closed position, wherein the removable lid covers the discharge opening of the hollow rigid member and the distal opening of the extendible spout and an open position, wherein the removable lid allows a pourable material to pass through the discharge opening of the hollow rigid member and the distal opening of the extendible spout, wherein the removable lid further comprises: a first sealing flange which engages with the top end of the hollow member to form a seal between the removable lid in the closed position and the hollow member; and a second sealing flange which engages with the distal end of the extendible spout to form a seal between the removable lid in the closed position and the extendible spout.

In another aspect, flexible material containers are provided. In one embodiment, the flexible material container includes a container having the pouring spout fitment described above.

DETAILED DESCRIPTION

Figure 1:
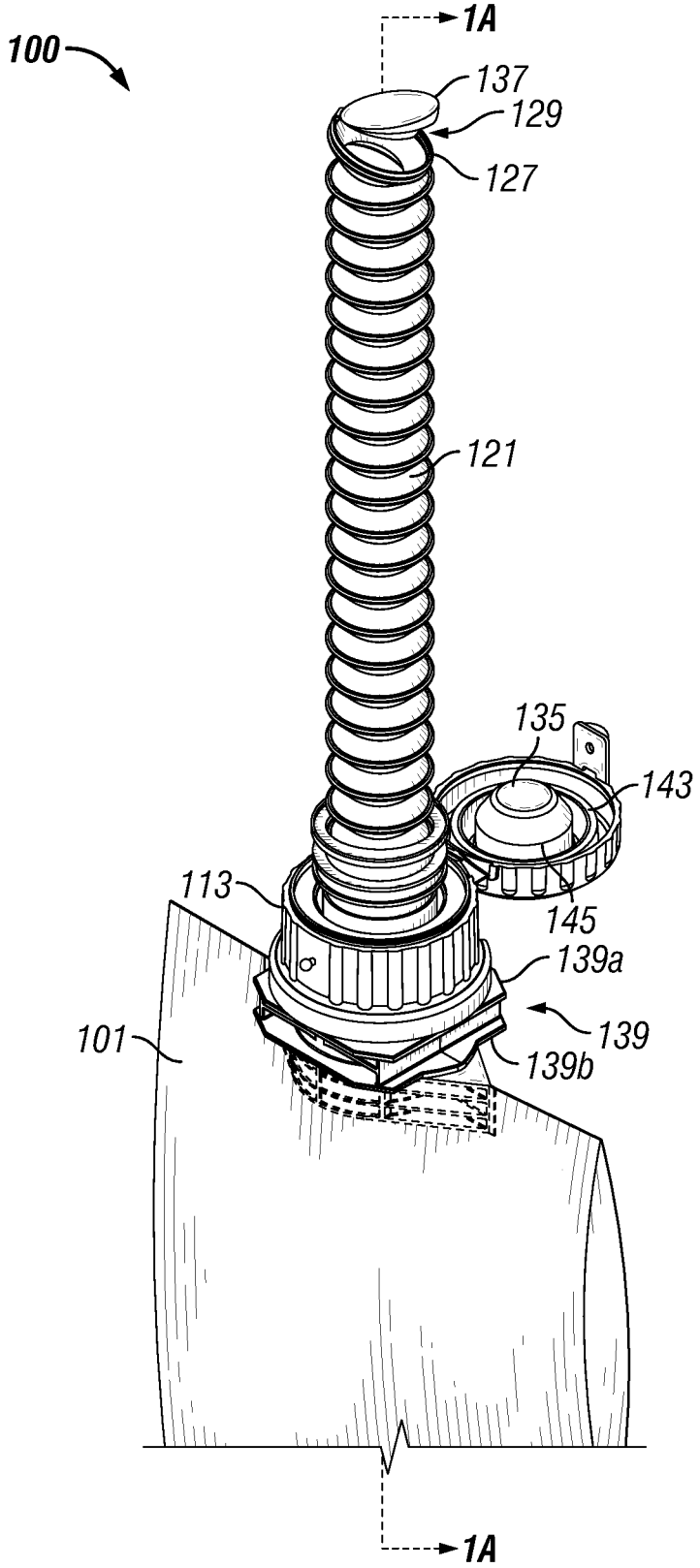
FIG. 1 is a perspective view of a dispensing system including a fitment and a detachable dispensing system disposed in a flexible container.

In the following description, numerous specific details are given to provide a thorough understanding of several embodiments. The embodiments can be practiced without one or more of the specific details, or with other components, materials, etc. In other instances, well-known structures, materials, or operations are not shown or described in detail in order to avoid obscuring aspects of the described embodiments.

Reference throughout this specification to "one embodiment," "an embodiment," or "embodiments" means a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Detachable Dispensing Systems for Flexible Containers

In some embodiments, dispensing systems for flexible containers are provided. These dispensing systems for flexible containers include a fitment and a detachable dispensing system. Embodiments of suitable detachable dispensing systems are described in detail in U.S. Pat. No. 9,550,606, which is hereby incorporated by reference herein in its entirety.

As used herein, "flexible container" means a container which is easily bendable or deformed between a variety of shapes. In some embodiments, the flexible container may be substantially flat before being filled with a material and assuming a three-dimensional shape. In these embodiments, the flexible container may advantageously return to a substantially flat, flexible shape for disposal once the material is emptied. In some embodiments, flexible containers may be made from suitable single or multi-layer films. In some embodiments, flexible containers may be made from polyolefins.

Fitments suitable for use with dispensing systems for flexible containers disclosed herein may include a canoe including a body having an outer surface and an inner surface defining a passage extending through the body, wherein the canoe is configured to be attached to the inner surface of a flexible package. The canoe may be any suitable size or shape for the flexible package, and is typically larger than the dispensing opening of the dispensing system. For example, the canoe may have an oblong boat-like shape, and may substantially surround a dispensing opening. In other embodiments, the canoe may have a cylindrical shape. In other embodiments, the canoe may have a relatively flat, circular shape. The canoe may be attached to the inner surface of a flexible package by welding, glue, adhesive, or any suitable attachment means.

In some embodiments, the fitment also includes a rail grabber portion. The rail grabber portion may be attached to the canoe portion. For example, the rail grabber portion may be located above the canoe portion, such that the rail grabber portion extends beyond the flexible container when the canoe portion is attached to the inner surface of a flexible container. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the fitment and flexible package with the fitment attached along standard manufacturing lines, according to methods which are known in the art.

In some embodiments, the fitment also includes attachment means configured to allow the detachable dispensing system to be selectively attached to the fitment and removed from the fitment. In some embodiments, the attachment means are threads. In some embodiments, the attachment means include at least one snapping element.

In some embodiments, the detachable dispensing system includes a handling portion having an outer ring and an inner ring. The outer ring is configured to selectively secure and, alternatively, remove the handling portion about a dispensing opening of the fitment. That is, the outer ring connects the handling portion to the container. The outer ring configuration advantageously enables the handling portion, and thus the system, to be attached to and removed from the fitment, when desired, rather than being permanently attached. As a result, the systems described herein can be repeatedly used with the same container or other containers, thereby allowing the containers to be resealed with its initial lid and/or seal after each allotment of pourable materials via the system or the container may be discarded. This feature minimizes contamination and spillage of the pourable material within the container between each allotment. The outer ring configuration also beneficially secures the system to the container so that unwanted spillage of the pourable material is minimized, if not avoided, during use and to prevent the pourable material of the container to be exposed to the environment when being dispensed therefrom.

In some embodiments, the handling portion is made of a thermoplastic material. Non-limiting examples of suitable thermoplastic materials include polypropylene, polyethylene, and the like. In some embodiments, the handling portion is formed by injection molding.

In embodiments, the detachable dispensing systems described herein also include a hollow rigid member that includes a top end and a base end. In some embodiments, the hollow rigid member is fixed within the handling portion. In other embodiments, the hollow rigid member is slideably disposed within the handling portion and selectively positionable between a recessed position and an extended position.

As used herein, "slideably disposed" means that the hollow rigid member is freely moveable through the handling portion unless otherwise fixed to the handling portion when in a recessed position or an extended position.

As used herein, "selectively positionable" when used to describe the hollow rigid member means capable of being moved and positioned, e.g. by a user, from a recessed position to an extended position and vice versa at desired times.

In some embodiments, the hollow rigid member is made of a thermoplastic material. Non-limiting examples of suitable thermoplastic materials include polypropylene, polyethylene, and the like. In some embodiments, the hollow rigid member is formed by injection molding.

In operation, when the hollow rigid member is in the extended position, the base end of the hollow rigid member, in some embodiments, may be substantially flush with the dispensing opening of the fitment, whereas in other embodiments, the base end may be substantially flush with the inner ring of the handling portion. As used herein, the term "flush" when used to describe the position of the base end of the hollow rigid member in relation to another component of the detachable dispensing system means immediately adjacent to or directly abutting such component. In an embodiment, when the hollow rigid member is in the extended position, the hollow rigid member may be partially disposed within the container. For example, in one embodiment, at least a portion of the base end of the hollow rigid member may be partially disposed within the container above the fill line for the pourable material. In some embodiments, the hollow rigid member has one or more protrusions at its base end to prevent the base end of the hollow rigid member from extending beyond the dispensing opening of the fitment. For example, in some embodiments, the hollow rigid member may have a base end which is flared, such that the diameter of the base end is larger than the diameter of the top end of the hollow rigid member. In embodiments where the hollow rigid member has a base end which is flared, the hollow rigid member may advantageously easily form a seal with the inner ring of the handling portion, even accounting for variations in the inner diameter of the inner ring of the handling portion. For example, because the base end is flared, it can form a seal with the inner ring of the handling portion even if the inner ring of the handling portion is slightly larger than its designed dimension.

In some embodiments, the detachable dispensing system also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible package through the distal opening when the handling portion is engaged about the dispensing opening of the fitment, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible package to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the detachable dispensing systems with the ability to dispense material from a container into various destinations without having to disconnect the system from the container.

In one embodiment, a user may insert a finger or tool into the distal end of the extendible spout to adjust the extendible spout from one extended length to a second extended length, when desired.)

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the detachable dispensing system includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the detachable dispensing system includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the detachable dispensing system includes a removable lid that covers the top end of the hollow rigid member, when the hollow rigid member is in the recessed position. In one embodiment, the removable lid is hingedly connected to the hollow rigid member. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit. In another embodiment, the removable lid includes inner one or more threads configured to engage the outer one or more threads that are disposed on the outer periphery of the handling portion.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position. The two sealing flanges may offer additional security against the leaking or unintended pouring of the contents of the flexible package. Further, the second sealing flange may prevent the contents of the flexible package from leaking onto the exterior of the extendible spout. In this way, the outer surface of the extendible spout, which is likely to be grasped by a user seeking to pour the contents of the flexible package, may be kept clean even if the extendible spout is extended and retracted. In other words, a user may be able to use only a portion of the contents of the flexible package, re-close the package, and still find the extendible spout suitable for use upon re-opening the flexible package. In some embodiments, the second sealing flange is a dome-shaped protrusion. In these embodiments, the second sealing flange may advantageously serve as a self-centering feature, to center the distal opening of the extendible spout about the second sealing flange, so that the distal opening of the extendible spout can be sealed by the second sealing flange merely by closing the lid.

Pouring Spout Fitments

In some embodiments, a pouring spout fitment for a flexible container is provided. In some embodiments, the fitments may include a canoe comprising a body having an outer surface and an inner surface defining a passage extending through the body, wherein the canoe is configured to be attached to the inner surface of a flexible package. The canoe may be any suitable size or shape for the flexible package, and is typically larger than the dispensing opening of the dispensing system. For example, the canoe may have an oblong boat-like shape, and may substantially surround a dispensing opening. In other embodiments, the canoe may have a cylindrical shape. In other embodiments, the canoe may have a polygonal shape. The canoe may be attached to the inner surface of a flexible package by welding, glue, adhesive, or any suitable attachment means.

In some embodiments, the pouring spout fitment further include a hollow rigid member, at least partially disposed within the hollow canoe portion. That is, at least a portion of the hollow rigid member may be within the hollow canoe portion. The hollow rigid member may include a top end, which has a discharge opening, and a base end having a base opening, where the base opening and the discharge opening are in fluid communication with one another. In some embodiments, the base end of the hollow rigid member may extend below the hollow canoe portion. In some embodiments, there may be an annular space created between the outer surface of the hollow rigid member and the inner surface of the hollow canoe portion. This annular space may advantageously assist in preventing unwanted spillage from the flexible container. For example, users often struggle with dispensing fluids from flexible containers, because the pressure imparted by a user's grasp of the container can cause the fluid contained within it to flow out of the dispensing opening, particularly during opening of the container, when additional pressure may be applied by a user. In embodiments where this annular space is present, however, the material in the flexible container can flow into this annular space, such that there is less likelihood of spillage through the dispensing opening. In some embodiments, the outer surface of the hollow rigid member may be connected to the hollow canoe portion, so that no annular space is created. In these embodiments, it may be advantageously easier for a user to empty the entirety of the contents of the flexible package.

In some embodiments, the pouring spout fitment also includes a rail grabber portion. The rail grabber portion may be attached to the canoe portion. For example, in some embodiments, the rail grabber portion may be located above the canoe portion, or away from the flexible package, such that the rail grabber portion extends beyond the flexible container when the canoe portion is attached to the inner surface of a flexible container. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the fitment and flexible package with the fitment attached along standard manufacturing lines, according to methods which are known in the art.

In some embodiments, the pouring spout fitment also includes attachment means configured to receive a cap. The lid may be selectively attached and removed from the pouring spout fitment, and may serve to close the dispensing opening. In some embodiments, the attachment means are threads. In some embodiments, the attachment means are one or more snapping elements. The lid may be of any suitable design. For example, the lid may be a screw-on closure, a snap on closure, a safety seal, or a hinged cap.

In some embodiments, the pouring spout fitment also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible package through the distal opening when the hollow canoe portion is attached to the inner surface of the flexible container, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible package to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the detachable dispensing systems with the ability to dispense material from a container into various destinations without having to disconnect the system from the container.

In one embodiment, a user may insert a finger or tool into the distal end of the extendible spout to adjust the extendible spout from one extended length to a second extended length, when desired.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the pouring spout fitment includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the pouring spout fitment includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the pouring spout fitment includes a handling portion. The handling portion may substantially surround at least a portion of the hollow rigid member. The handling portion may be textured, or contain a plurality of ridges or protrusions to enhance its graspability by the user. In some embodiments, the handling portion may be at the top end of the hollow rigid member.

In some embodiments, the pouring spout fitment includes a removable lid that covers the top end of the hollow rigid member, when the hollow rigid member is in the recessed position. In one embodiment, the removable lid is hingedly connected to the hollow rigid member. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position. The two sealing flanges may offer additional security against the leaking or unintended pouring of the contents of the flexible package. Further, the second sealing flange may prevent the contents of the flexible package from leaking onto the exterior of the extendible spout. In this way, the outer surface of the extendible spout, which is likely to be grasped by a user seeking to pour the contents of the flexible package, may be kept clean even if the extendible spout is extended and retracted. In other words, a user may be able to use only a portion of the contents of the flexible package, re-close the package, and still find the extendible spout suitable for use upon re-opening the flexible package. In some embodiments, the flexible package may comprise a hollow friction fitting. In these embodiments, the canoe may be configured to attach to the inner surface of this hollow friction fitting. For example, the canoe may comprise friction fit means, such as ridges and/or barbs which extend from the canoe and are configured to engage the inner surface of the hollow friction fitting. For example, the inner surface of the hollow friction fitting may include a plurality of ridges, valleys, barbs, or depressions which are complementary to the friction fit means on the canoe. In this way, the canoe and the friction fitting may form a seal, such that no material stored within the flexible package can escape through the interface between the hollow friction fitting and the canoe. In some embodiments, the outer diameter of the canoe may be slightly larger than the inner diameter of the hollow friction fitting. In some embodiments, the canoe and the hollow friction fitting may each comprise snapping elements, so that the hollow friction fitting and the canoe form a snap interference fit. As used herein, a "snap interference fit" means a stationary coupling of the hollow friction fitting to the canoe as a result of at least one or more snapping elements.

The hollow friction fitting may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

In some embodiments, the pourable material is a fluid. In embodiments, the fluid is a liquid or the combination of a liquid and a gas. Non-limiting examples of suitable fluids include motor oil, and the like. In other embodiments, the pourable material is a flowable solid. Non-limiting examples of suitable flowable solids includes sand, pebbles, and the like. In yet other embodiments, the pourable material is a combination of a fluid and flowable solid.

Friction Pouring Spout Fitments

In some embodiments, friction fitments for flexible containers are provided. In some embodiments, the flexible containers comprise a hollow friction fitting. In some embodiments, the inner surface of the hollow friction fitting may include a plurality of ridges, valleys, barbs, or depressions configured to create a friction fit or a snap interference fit with the friction fitments described herein.

In some embodiments, the friction fitment comprises a hollow rigid member. The hollow rigid member may include a top end, which has a discharge opening, and a base end having a base opening, where the base opening and the discharge opening are in fluid communication with one another. The hollow rigid member may include an outer surface and an inner surface. The outer surface of the hollow rigid member may include a plurality of ridges, valleys, barbs, or depressions configured to create a friction fit or a snap interference fit with the hollow friction fitting of the flexible container. For example, in some embodiments the ridges, valleys, barbs, or depressions on the inner surface of the hollow friction fitting may be complimentary to those on the outer surface of the hollow rigid member. In this way, the hollow rigid member and the friction fitting may form a seal, such that no material stored within the flexible package can escape through the interface between the hollow friction fitting and the hollow rigid member. In some embodiments, the outer diameter of the hollow rigid member may be slightly larger than the inner diameter of the hollow friction fitting. In some embodiments, the hollow rigid member and the hollow friction fitting may each comprise snapping elements, so that the hollow friction fitting and the canoe form a snap interference fit. As used herein, a "snap interference fit" means a stationary coupling of the hollow friction fitting to the hollow rigid member as a result of at least one or more snapping elements.

In some embodiments, the hollow rigid member further includes a rail grabber portion. The rail grabber portion may be located at or near the top end of the hollow rigid member, such that the rail grabber portion extends beyond the flexible container when the friction fitment is attached to the flexible container. In some embodiments, the rail grabber portion substantially surrounds at least a portion of the hollow rigid member. In some embodiments, the rail grabber portion may consist of two or more protrusions which extend outward around a dispensing opening. The rail grabber portion is configured to allow for easy transport of the friction fitment and flexible package with the fitment attached along standard manufacturing lines, according to methods which are known in the art.

The hollow friction fitting may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

The hollow rigid member may be made of any suitable material. In some embodiments, the hollow friction fitting is made of a thermoplastic material. Non-limiting examples of suitable thermoplastic materials include polypropylene, polyethylene, and the like. In some embodiments, the hollow friction fitting is formed by injection molding.

In some embodiments, the friction fitment further comprises a handling portion. This handling portion is configured to extend beyond the opening of the flexible package, and substantially surrounds at least a portion of the hollow rigid member. Thus, when the friction fitment has been installed in a flexible package, a user may be able to lift, move, and manipulate the flexible container in party by grasping the handling portion. In some embodiments, the handling portion may include features to improve its graspability by a user. For example, the handling portion may be textured, or include a plurality of ridges or protrusions to make it more easily graspable by a user.

In some embodiments, the friction fitment also includes an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the flexible package through the distal opening when the friction fitment is attached to the flexible package, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the flexible package to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer. In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the friction fitments with the ability to dispense material from a container into various destinations without having to disconnect the system from the container.

In one embodiment, a user may insert a finger or tool into the distal end of the extendible spout to adjust the extendible spout from one extended length to a second extended length, when desired.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the pouring spout fitment includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the pouring spout fitment includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the friction fitment includes a removable lid that covers the top end of the hollow rigid member, when the hollow rigid member is in the recessed position. In one embodiment, the removable lid is hingedly connected to the hollow rigid member. In one embodiment, the removable lid is hingedly connected to the handling portion. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit.

In some embodiments, the removable lid includes one or more sealing flanges configured to form a seal between the removable lid and the hollow member or extendible spout. For example, in some embodiments the removable lid includes a first sealing flange configured to engage the top end of the hollow member to form a seal between the removable lid and the hollow member when the removable lid is in the closed position. In some embodiments, the removable lid includes a second sealing flange configured to engage the distal end of the extendible spout to form a seal between the removable lid and the extendible spout when the removable lid is in a closed position.

In some embodiments, the pourable material is a fluid. In embodiments, the fluid is a liquid or the combination of a liquid and a gas. Non-limiting examples of suitable fluids include motor oil, and the like. In other embodiments, the pourable material is a flowable solid. Non-limiting examples of suitable flowable solids includes sand, pebbles, and the like. In yet other embodiments, the pourable material is a combination of a fluid and flowable solid.

Illustrated Dispensing Systems

FIGS. 1-7 depict an exemplary embodiment of a dispensing system for use with a flexible package which includes a detachable dispensing system in various configurations.

Figure 1A:
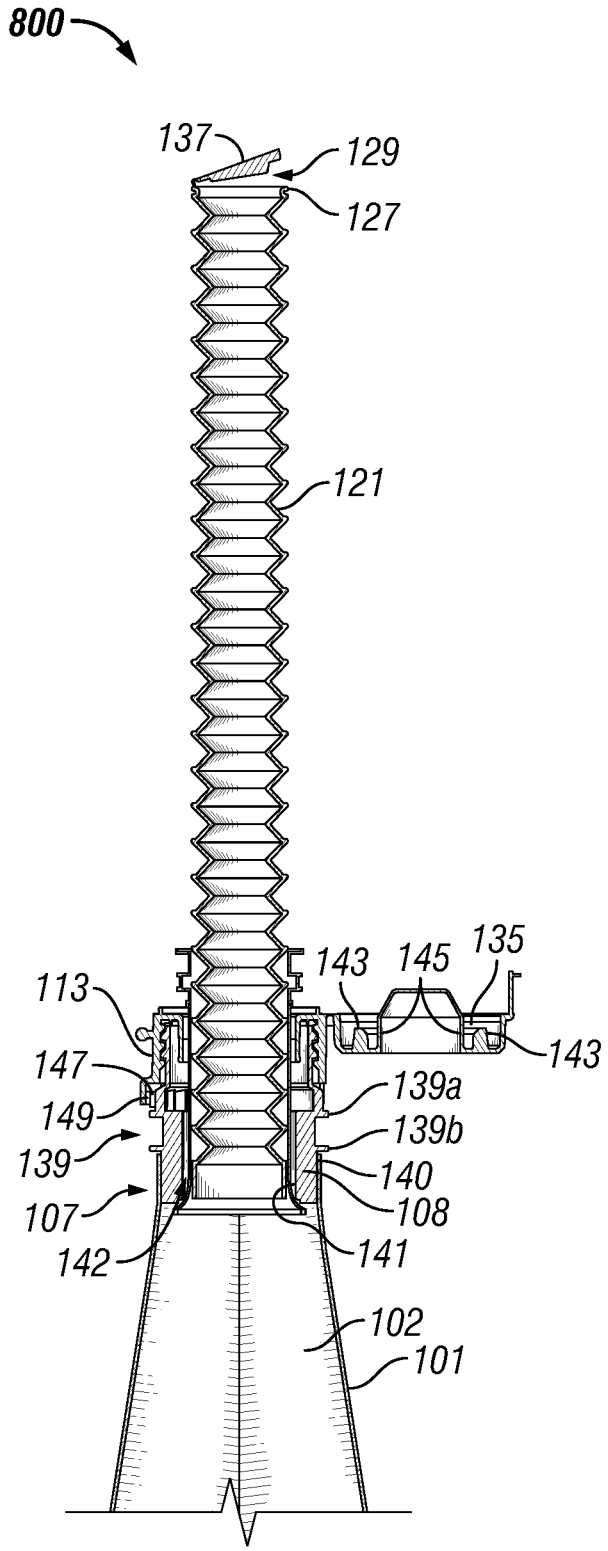
FIG. 1A is a cross-section of the dispensing system and flexible container of FIG. 1, taken along line A-A.
Figure 2:
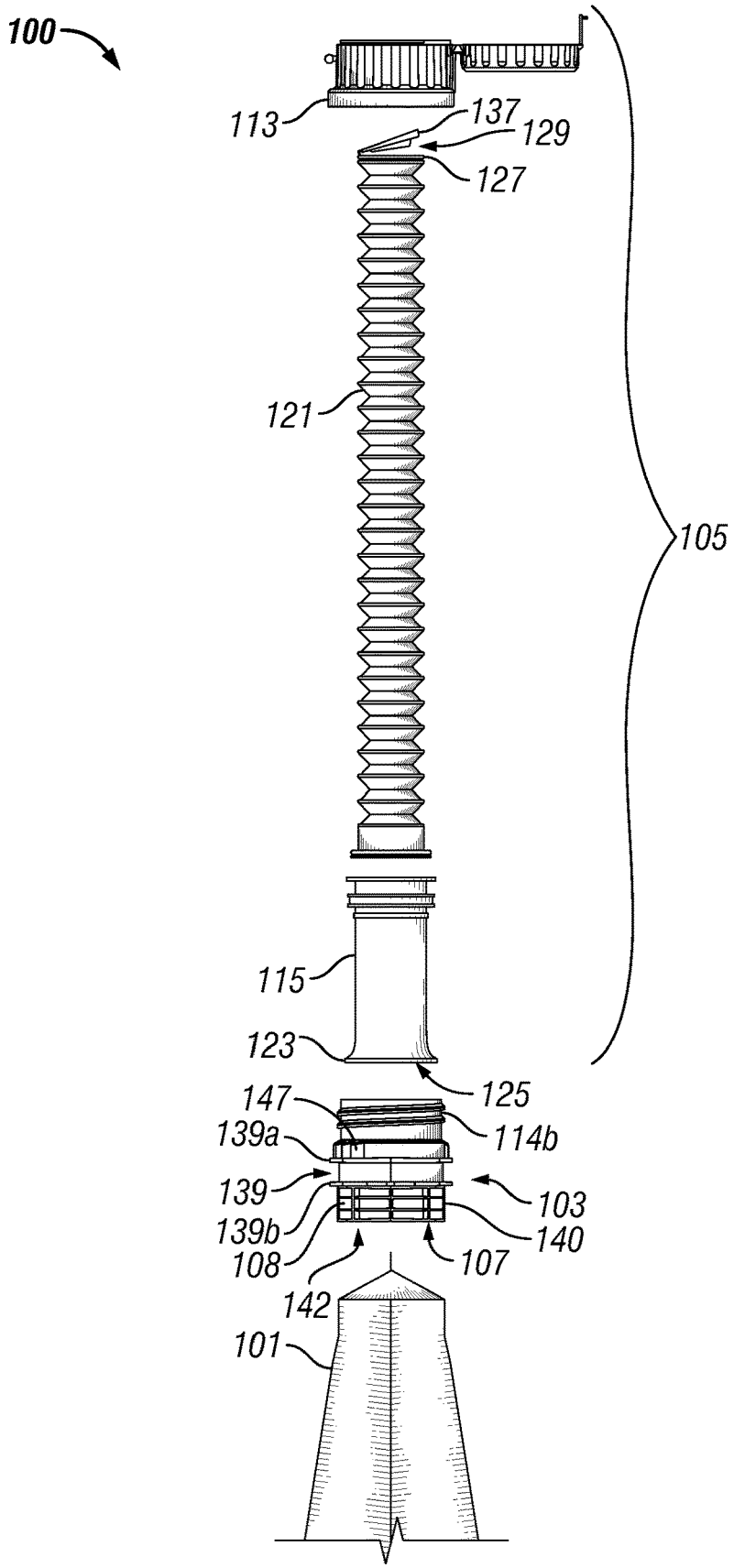
FIG. 2 is an exploded view of the dispensing system and flexible container of FIG. 1.

FIGS. 1 and 1A illustrate a dispensing system 100 for a flexible container 101, which includes a fitment 103 and a detachable dispensing system 105. FIG. 2 shows an exploded view of the dispensing system 100 and flexible container 101 of FIGS. 1 and 1A. The fitment 103 includes a canoe 107 having a body 108 with an outer surface 140 and an inner surface 141 defining a passage 142 extending through the body 108, where the outer surface 141 is configured to be attached to the inner surface 102 of the flexible container 101. The fitment 103 further includes threads 109 surrounding a dispensing opening 111, wherein the threads 109 are configured to engage the detachable dispensing system 105. The fitment 103 further includes a rail grabber portion 139 consisting of two planar protrusions 139*a* and 139*b*. These protrusions are configured to allow the fitment and a flexible package attached to the fitment 103 to be easily transported along typical manufacturing equipment used in the assembly and filling of flexible containers, according to methods known in the art.

The dispensing system 100 includes a handling portion 113 having an outer ring and an inner ring. The outer ring is configured to selectively secure and, alternatively, remove the handling portion about a dispensing opening 111 of the fitment 103. That is, the outer ring connects the handling portion 113 to the container by connecting threads 114*a* to threads 114*b* on the fitment. The outer ring configuration advantageously enables the handling portion 113, and thus the system, to be attached to and removed from the fitment 103, when desired, rather than being permanently attached.

Figure 3:
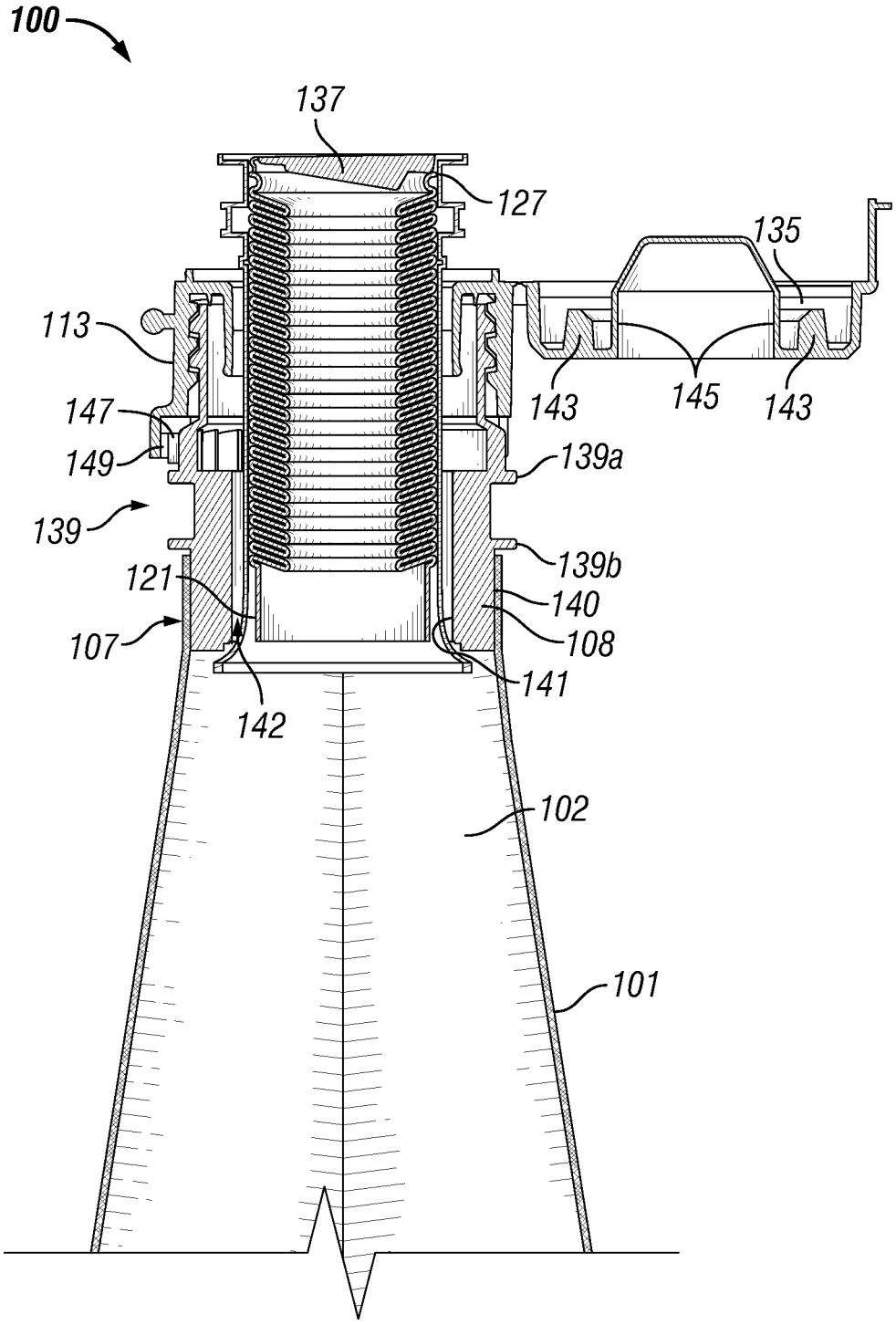
FIG. 3 is a cross-section of the dispensing system and flexible container of FIG. 1 as shown in FIG. 1A, where the extendible spout is shown in a retracted position.

The detachable dispensing system 105 also includes an extendible spout 121 that is at least partially disposed in and connected to the hollow rigid member 115. The extendible spout 121 includes a proximal end 123 and a proximal opening 125, a distal end 127 and a distal opening 129, and a discharge passage 131. The proximal end 113 is connected to the hollow rigid member 115, the distal end 127 is configured to extend from and retract at least partially into the hollow rigid member 115, and the discharge passage 131 extends from the proximal opening 125 to the distal opening 129. The extendible spout 121 is movable from a retracted position, as shown in FIG. 3, and an extended position, as shown in FIGS. 1, 1A, and 2. The extendible spout 121 is configured to dispense the pourable material from the flexible package 101 through the distal opening 129 when the handling portion 113 is engaged about the dispensing opening 111 of the fitment 103.

Figure 4:
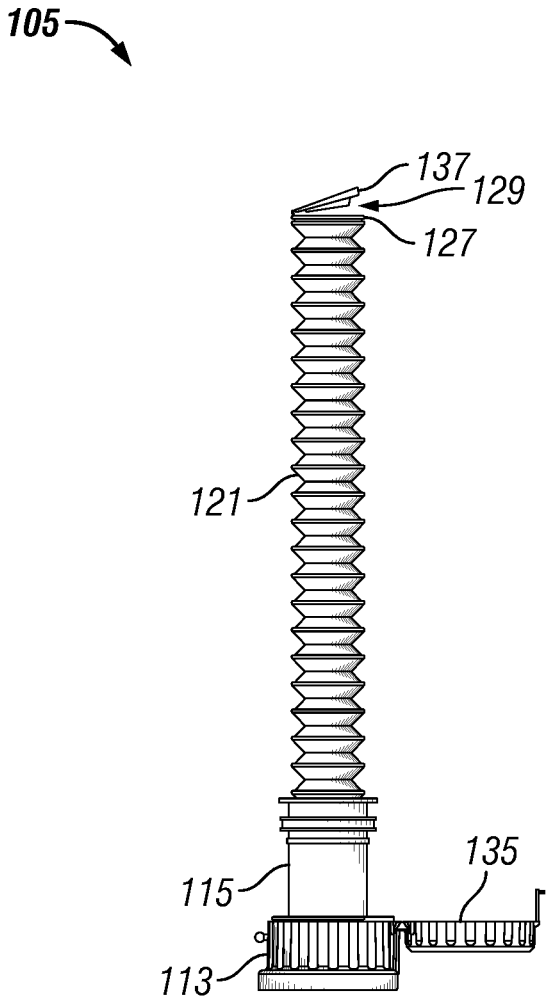
FIG. 4 is another perspective view of the detachable dispensing system of FIG. 1, wherein the hollow rigid member is in an extended position.

The detachable dispensing system 105 also includes a hollow rigid member 115 that includes a top end 117 and a flared base end 119. The hollow rigid member 115 is slideably disposed within the handling portion 113 and selectively positionable between a recessed position and an extended position. FIGS. 1, 1A, 2, and 3 illustrate the dispensing system 100 wherein the hollow rigid member 115 is in a recessed position, wherein the top end 117 is proximate the handling portion 113, and wherein the extendible spout 121 is shown in an extended position. FIG. 4 illustrates the detachable dispensing system wherein the hollow rigid member 115 is in an extended position, wherein the bottom end 119 is proximate the handling portion 113, and wherein the extendible spout 121 is in an extended position.

The dispensing system 100 further includes a safety seal 137 which is attached to the extendible spout 121 in an open configuration, where material can pass through the distal opening 129 of the extendible spout 121. The safety seal 137 is configured to seal the distal opening 129 of the extendible spout 121, and may also function as a pull tab to assist a user in extending the extendible spout 121.

The dispensing system includes a removable lid 135, which can be threadingly secured and removed from the handling portion 113. The removable lid 135 further includes a first sealing flange 143 and a second sealing flange 145 both extending inwardly from the inner surface of the removable lid 135. The first sealing flange 143 is configured to engage with the top end 117 of the hollow rigid member 115 when the removable lid 135 is in a closed position, where it is secured to the handling portion 113. The second sealing flange 145 is configured to engage with the distal end 127 of the extendible spout 121 when the removable lid 135 is in a closed position, where it is secured to the handling portion 113. The second sealing flange 145 is disposed inwardly of the first sealing flange 143.

Figure 5:
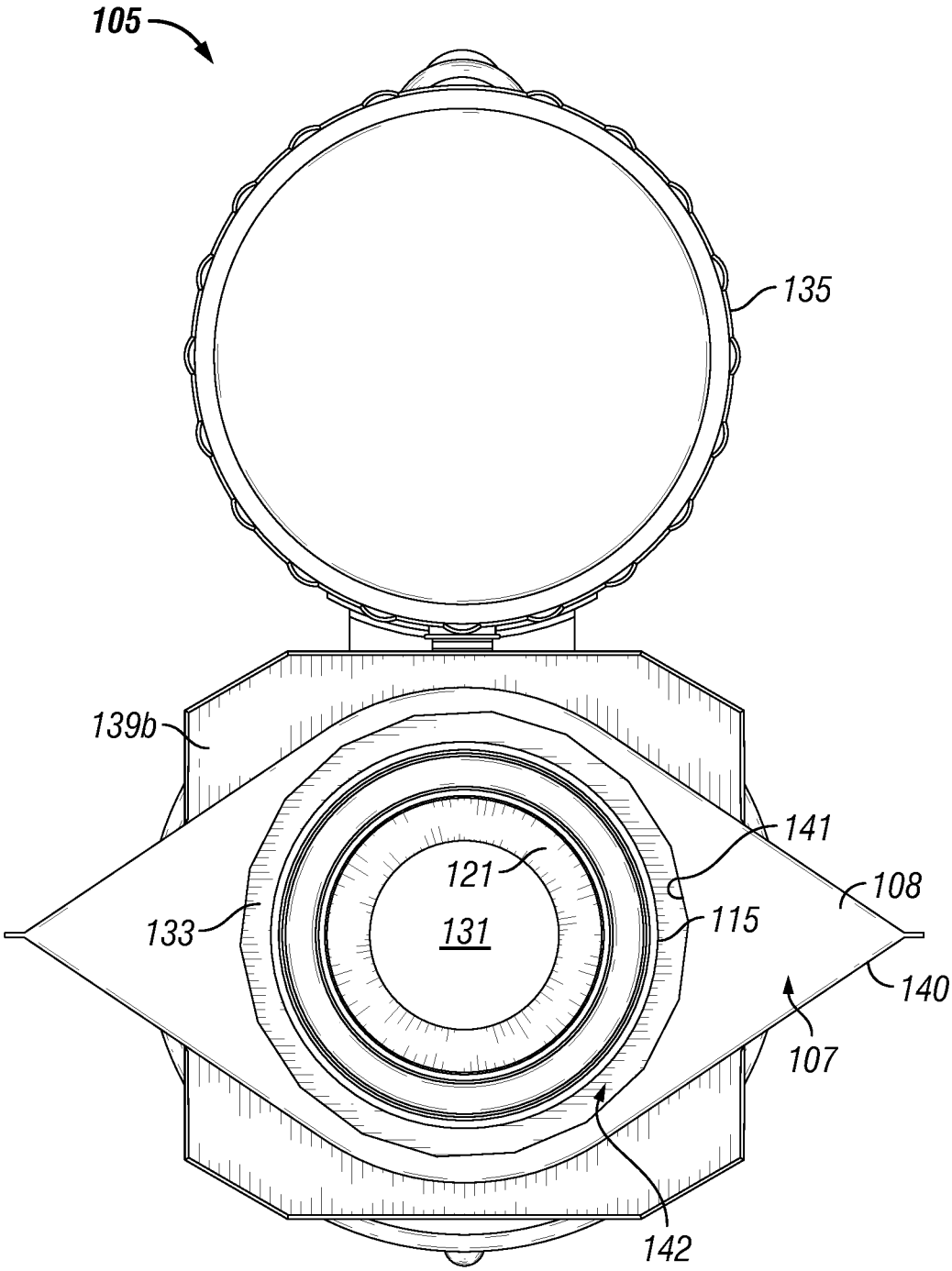
FIG. 5 is a bottom view of the detachable dispensing system of FIG. 1.
Figure 6:
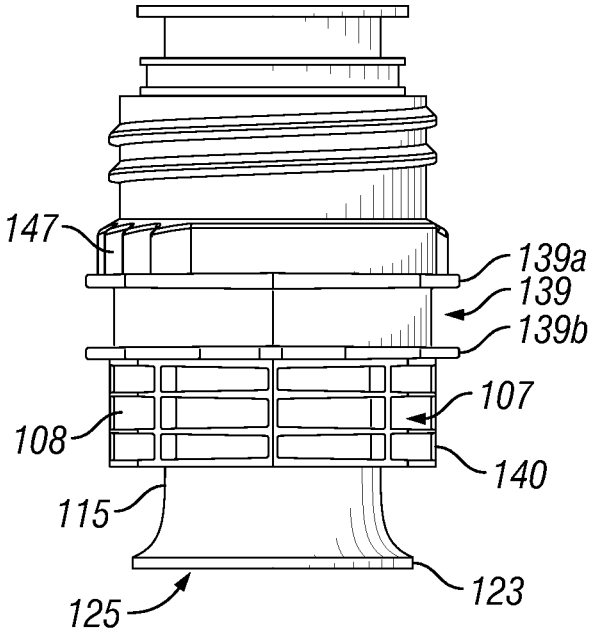
FIG. 6 is a partial perspective view of a portion of the dispensing system of FIG. 1.
Figure 7:
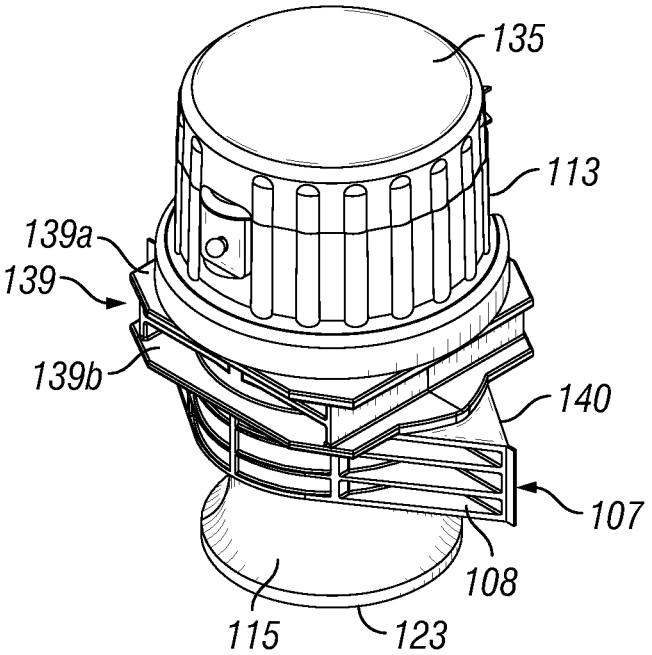
FIG. 7 is a perspective view of the detachable dispensing system of FIG. 1, wherein the removable lid is in a closed position.

The fitment 103 further includes a plurality of anti-backoff projections 147 on its outer surface, configured to engage a plurality of anti-backoff projections 149 on the removable lid 135. In this way, the removable lid 135 can be threadingly attached to the fitment 103, by the anti-backoff projections 147 and 149 will prevent the removable lid 135 from being inadvertently threadingly detached from the fitment 103. FIG. 5 is a bottom view of the dispensing system 100 of FIG. 1. As can be seen in FIG. 5, there may be an annular space 133 created between the hollow rigid member 115 and the canoe 107. FIG. 6 is a partial perspective view of the dispensing system 100 of FIG. 1. As can be seen in FIG. 6, the bottom end 119 of the hollow rigid member 115 may extend farther below than the canoe 107. In other words, the hollow rigid member 115 may extend further into the flexible package than the canoe 107 of the fitment 103. FIG. 7 is a perspective view of the dispensing system 100 wherein the removable lid 135 is shown in a closed position.

Illustrated Pouring Spout Fitments

FIGS. 8-11 depict an exemplary embodiment of a pouring spout fitment for use with a flexible package in various configurations.

Figure 8:
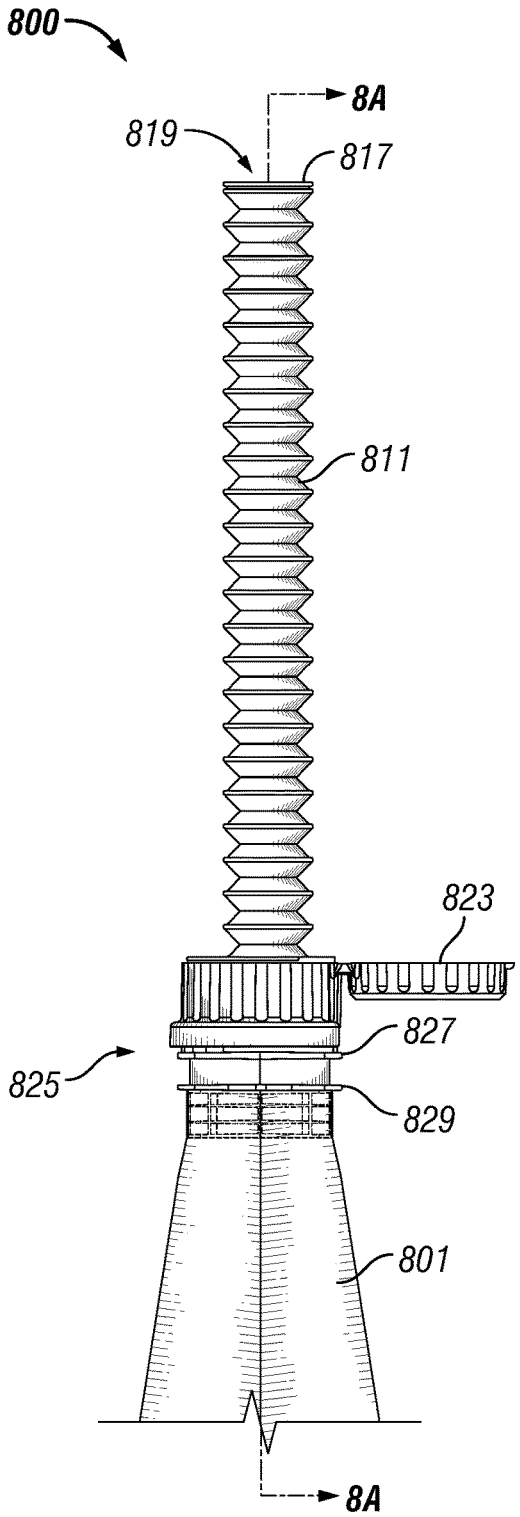
FIG. 8 is a perspective view of an embodiment of a pouring spout fitment disposed in a flexible container.
Figure 8A:
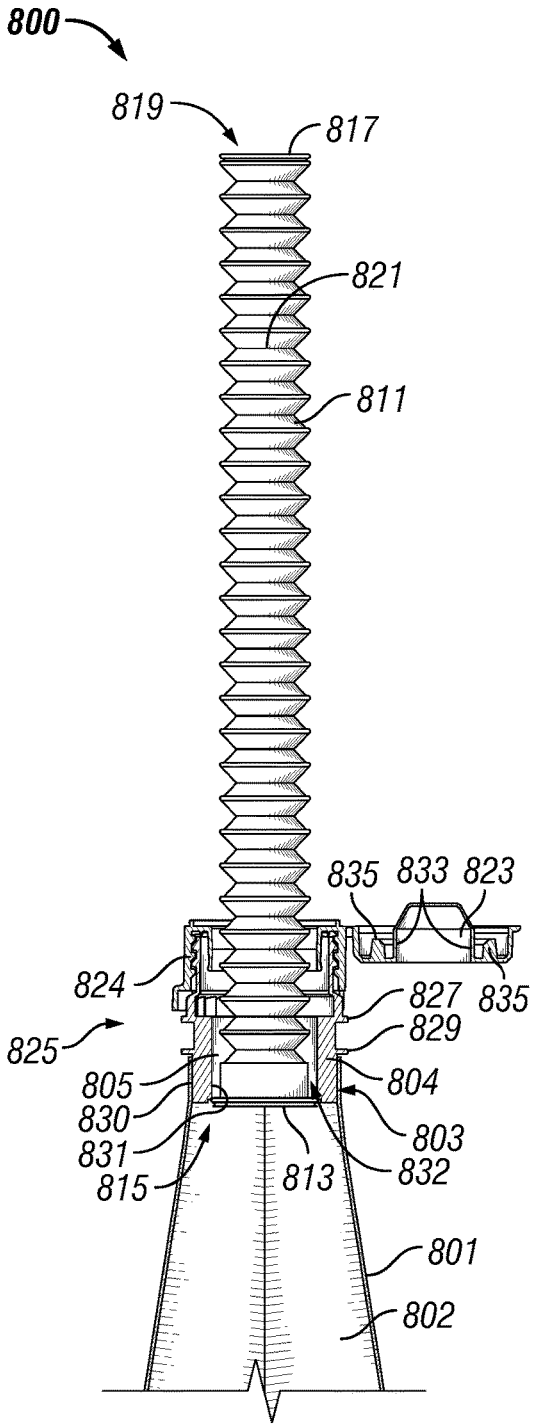
FIG. 8A is a is a cross-section of the pouring spout fitment and flexible container of FIG. 8, taken along line A-A.
Figure 9:
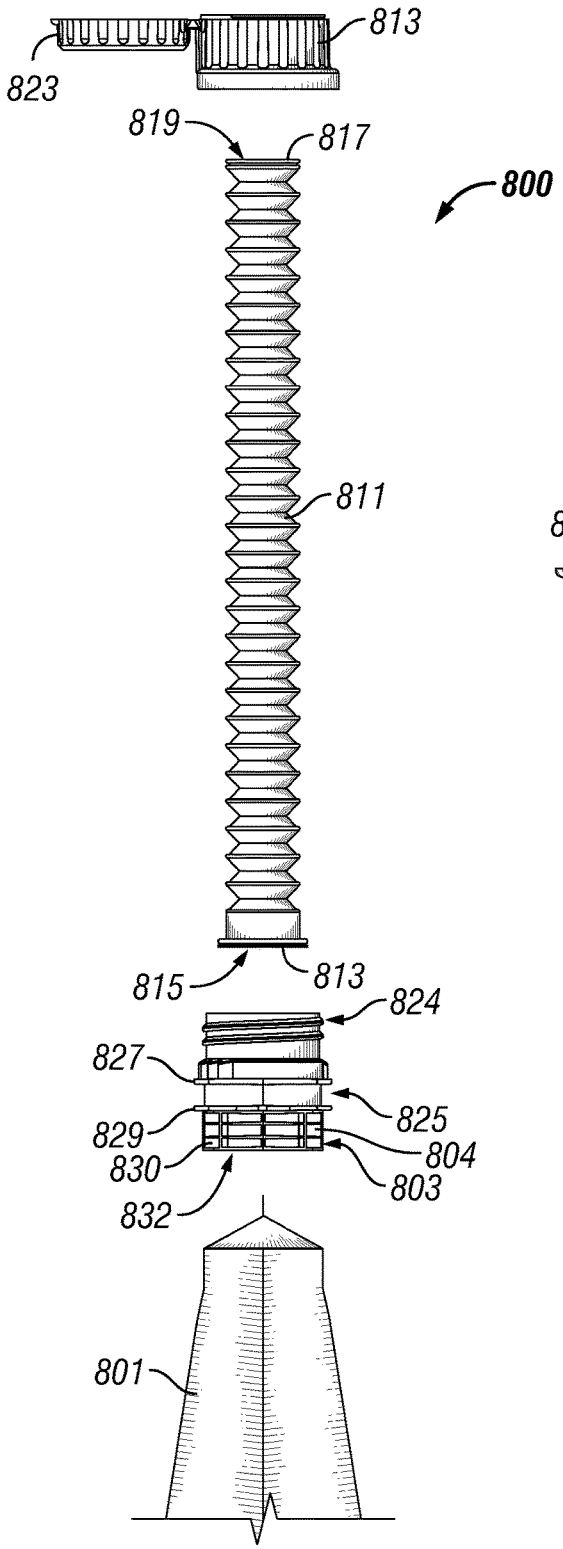
FIG. 9 is an exploded view of the pouring spout fitment and flexible container of FIG. 8.
Figure 10:
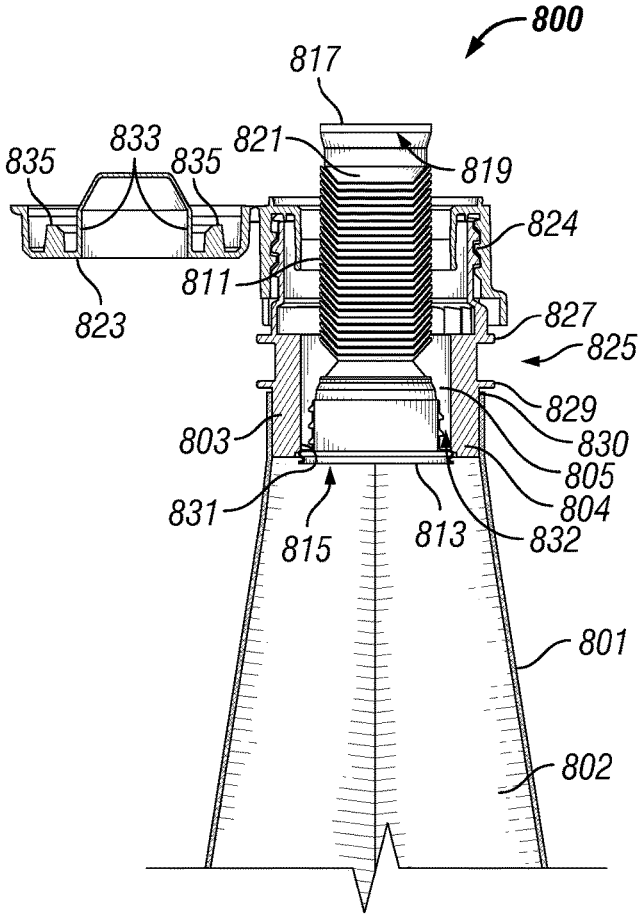
FIG. 10 is a cross-section of the pouring spout fitment and flexible container of FIG. 8 as shown in FIG. 8A, where the extendible spout is shown in a retracted position.

FIGS. 8 and 8A illustrate pouring spout fitment 800 for a flexible container 801, which includes a hollow canoe portion 803 having a body 804 with an outer surface 830 and an inner surface 831 defining a passage 832 extending through the body, wherein the outer surface 830 is configured to be attached directly to the inner surface 802 of a flexible container 801. FIG. 9 is an exploded view of the pouring spout fitment 800 and flexible container 801 of FIG. 8. For example, the hollow canoe portion 803 may be welded to the inner surface of a flexible container. The pouring spout fitment 800 further includes a hollow rigid member 805 having a top end 807 and a bottom end 809. The pouring spout fitment further includes an extendible spout 811 that is at least partially disposed in and connected to the hollow rigid member 805. The extendible spout 811 includes a proximal end 813 and a proximal opening 815, a distal end 817 and a distal opening 819, and a discharge passage 821. The proximal end 813 is connected to the hollow rigid member 805, the distal end 817 is configured to extend from and retract at least partially into the hollow rigid member 805, and the discharge passage 821 extends from the proximal opening 815 to the distal opening 819. The extendible spout is configured to extend between an extended position, wherein the distal end 817 extends from top end 807 of the hollow rigid member 805, and a retracted position, wherein the distal end 817 retracts at least partially into the hollow rigid member 805. The extendible spout 811 is configured to dispense the pourable material from the flexible package 801 through the distal opening 819 when the hollow canoe portion 803 is attached to the inner surface of the flexible package 801. FIGS. 1 and 1A illustrate the extendible spout in an extended configuration. The pouring spout fitment 800 further includes a removable lid 823, which is attached to the top end 807 of the hollow rigid member 805 by threads 824.

The removable lid 823 can be hingedly moved between an open position and a closed position, wherein the removable lid covers the distal end 817 of the extendable spout 811. The removable lid 823 further includes a first sealing flange 833 and a second sealing flange 835 both extending inwardly of the inner surface of the removable lid 823. The first sealing flange 833 is configured to engage with the top end 807 of the hollow rigid member 805 when the removable lid 823 is in a closed position. The second sealing flange 835 is configured to engage with the distal end 817 of the extendible spout 811 when the removable lid 823 is in a closed position. The second sealing flange 835 is disposed inwardly of the first sealing flange 833 The pouring spout fitment 803 further includes a rail grabber portion 825 consisting of two planar protrusions 827 and 829. These protrusions are configured to allow the fitment 803 and a flexible package 801 attached to the fitment 103 to be easily transported along typical manufacturing equipment according to methods known in the art.

Figure 11:
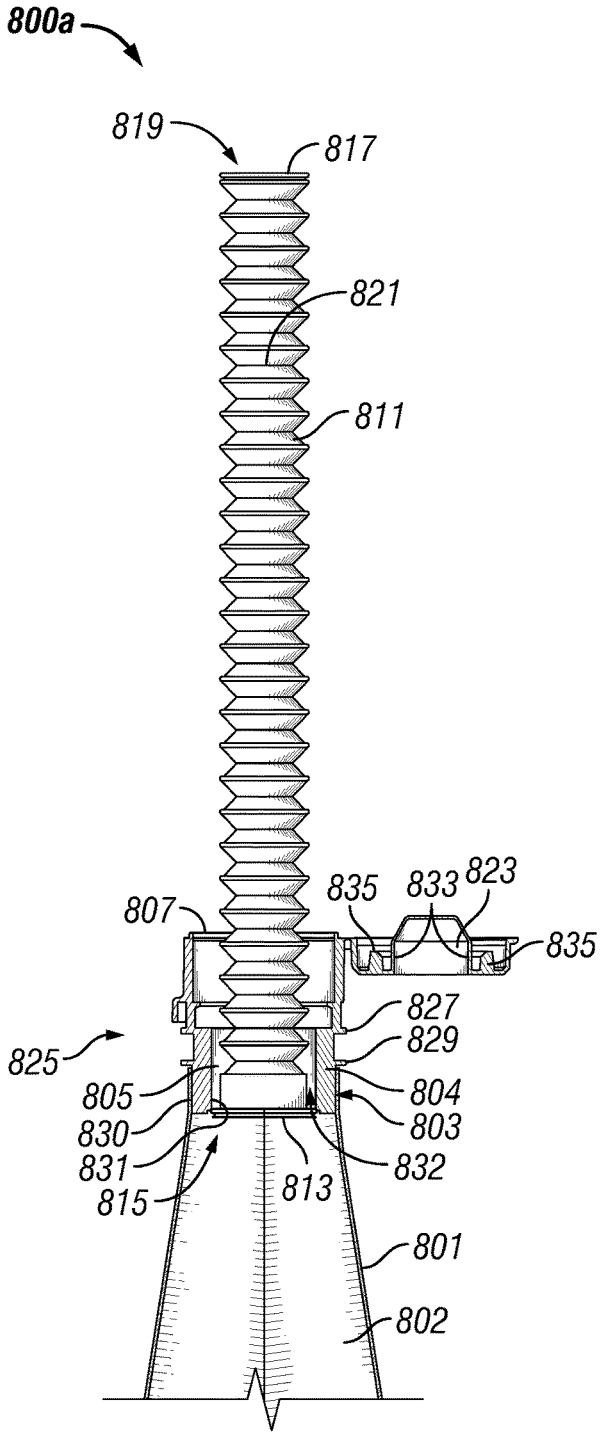
FIG. 11 is a cross-sectional view of a one-piece embodiment of the pouring spout fitment of FIG. 8.

FIG. 11 illustrates an alternate embodiment of the pouring spout fitment 800, 800*a*. This embodiment includes a hollow rigid member 805, a hollow canoe portion 803, a rail grabber portion 825, and an extendible spout 811 as described above. However, in this embodiment the lid 823*a* is integral with the remainder of the fitment 800*a*. In this embodiment, the lid 823*a* may be formed in a single injection molding step, and is hingedly connected to the hollow rigid member 805, rail grabber portion 825, and hollow canoe portion 803.

FIGS. 12-15 depict an exemplary embodiment of a pouring spout fitment with friction fit attachment means for use with a flexible package in various configurations.

Figure 12:
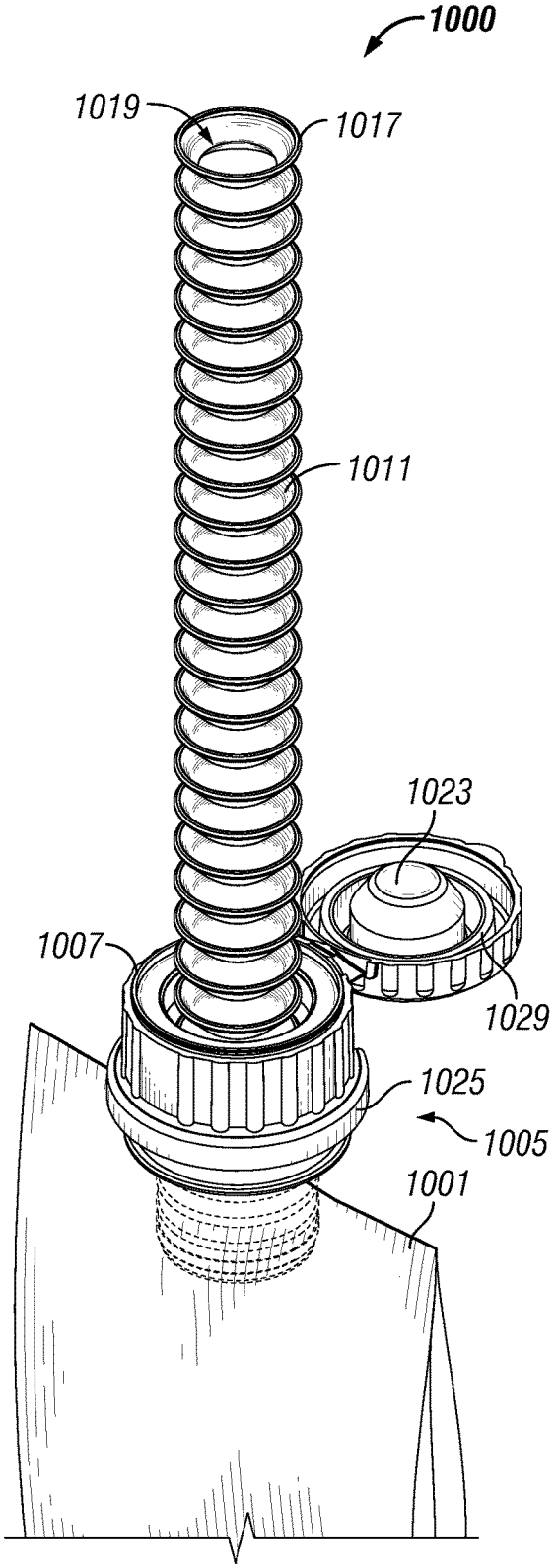
FIG. 12 is a perspective view of an embodiment of a friction pouring spout fitment disposed in a flexible container.
Figure 12A:
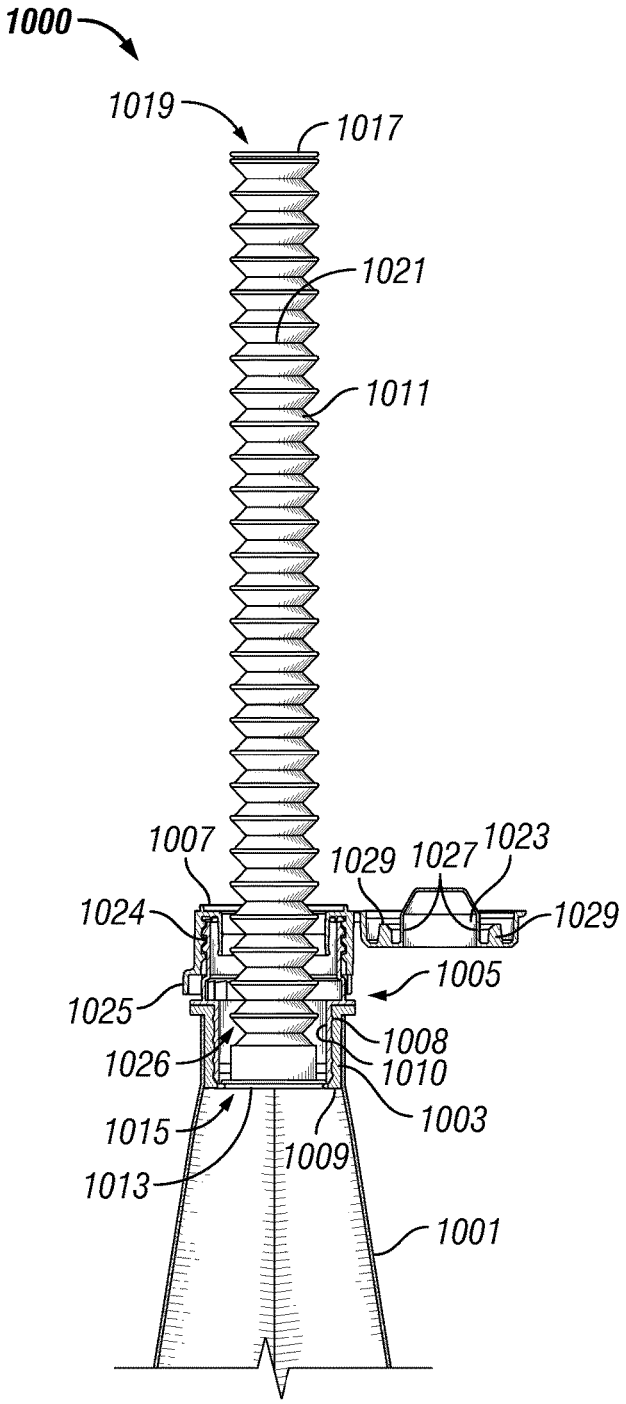
FIG. 12A is a cross-section of the pouring spout fitment and flexible container of FIG. 12, taken along line A-A.
Figure 13:
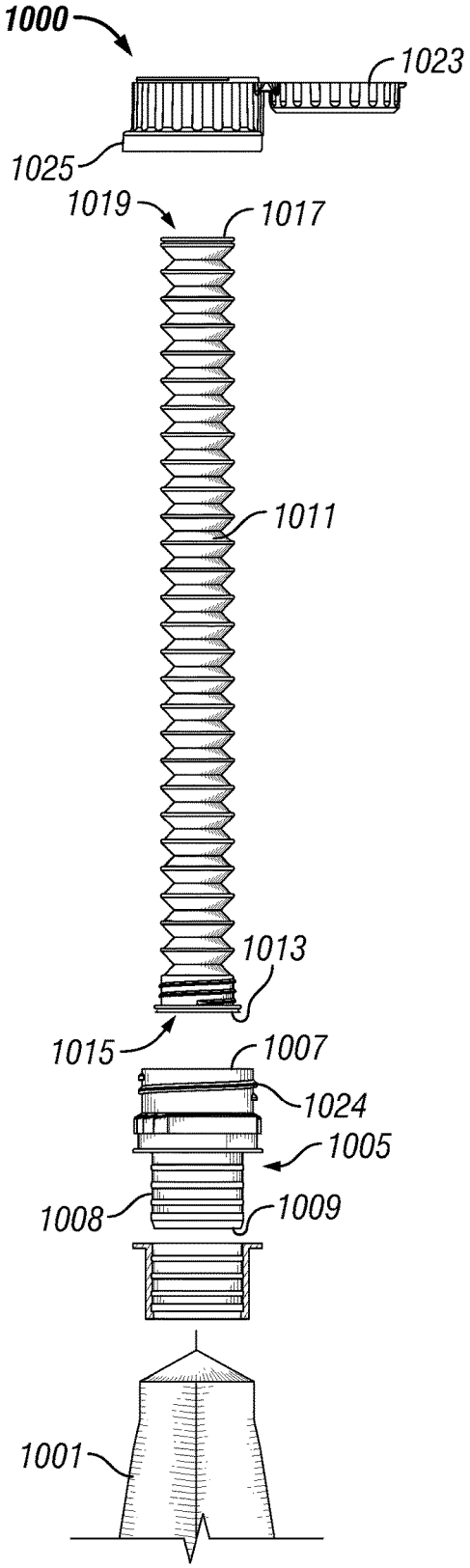
FIG. 13 is an exploded view of the pouring spout fitment and flexible container of FIG. 12.

FIGS. 12 and 12A illustrate pouring spout fitment 1000 for a flexible container 1001. FIG. 12A depicts a cross-sectional view of the pouring spout fitment 1000 of FIG. 10, taken along line A-A. The pouring spout fitment 1000 includes a hollow rigid member 1005 having a top end 1007 and a bottom end 1009, an outer surface 1008, and an inner surface 1010. The pouring spout fitment 1000 further includes an extendible spout 1011 that is at least partially disposed in and connected to the hollow rigid member 1005. The extendible spout 1011 includes a proximal end 1013 and a proximal opening 1015, a distal end 1017 and a distal opening 1019, and a discharge passage 1021. The proximal end 1013 is connected to the hollow rigid member 1005, the distal end 1017 is configured to extend from and retract at least partially into the hollow rigid member 805, and the discharge passage 1021 extends from the proximal opening 1015 to the distal opening 1019. The extendible spout is configured to extend between an extended position, wherein the distal end 1017 extends from top end 1007 of the hollow rigid member 1005, and a retracted position, wherein the distal end 1017 retracts at least partially into the hollow rigid member 1005. The extendible spout 1011 is configured to dispense the pourable material from the flexible package 1001 through the distal opening 1019 when the hollow canoe portion 1003 is attached to the inner surface of the flexible package 1001. FIGS. 12 and 12A, and 13 illustrate the extendible spout in an extended configuration.

The pouring spout fitment 1000 further includes a rail grabber portion 1025 having a single protrusion configured to allow the fitment 1000 and a flexible package 1001 attached to the fitment 1000 to be easily transported along typical manufacturing equipment according to methods known in the art. The pouring spout fitment 1000 further includes a removable lid 1023, which is attached to the top end 1007 of the hollow rigid member 1005 by threads 1024.

The removable lid 1023 can be hingedly moved between an open position and a closed position, wherein the removable lid covers the distal end 1017 of the extendable spout 1011. The removable lid 1023 further includes a first sealing flange 1027 and a second sealing flange 1029. The first sealing flange 1027 is configured to engage with the top end 1007 of the hollow rigid member 1005 when the removable lid 1023 is in a closed position. The second sealing flange 1029 is configured to engage with the distal end 1017 of the extendible spout 1011 when the removable lid 1023 is in a closed position. Both the first sealing flange 1027 and the second sealing flange 1029 extend inwardly from the inner surface of the removable lid 1023. The second sealing flange 1029 is disposed inwardly of the first sealing flange 1027.

Figure 14:
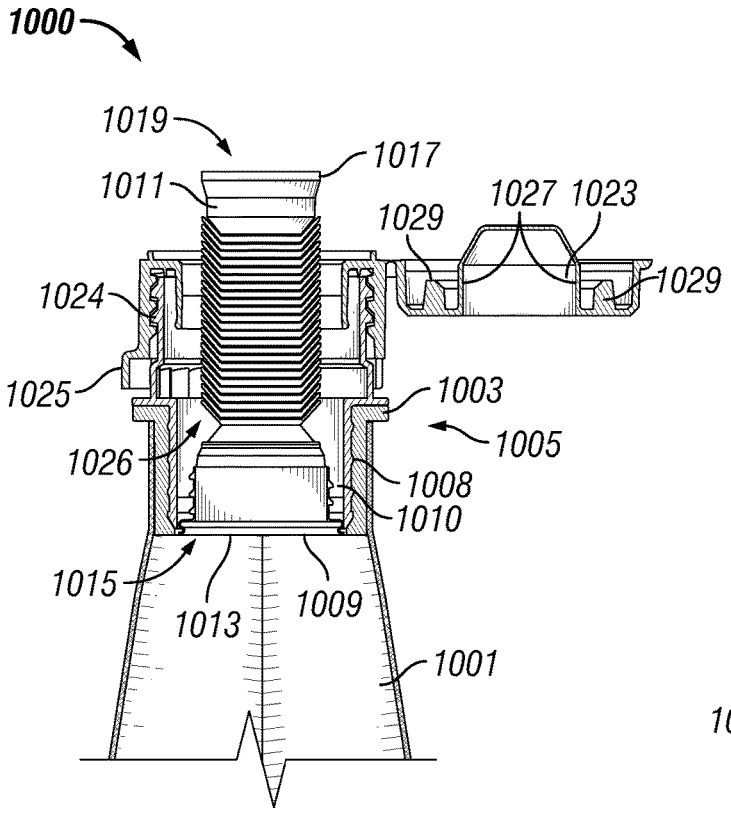
FIG. 14 is a cross-section of the pouring spout fitment and flexible container of FIG. 12 as shown in FIG. 12A, where the extendible spout is shown in a retracted position.

FIG. 14 illustrates a cross-section of the pouring spout fitment 1000 and flexible package 1001 of FIG. 12 as shown in FIG. 12A, where the extendible spout is shown in a retracted position.

Figure 15:
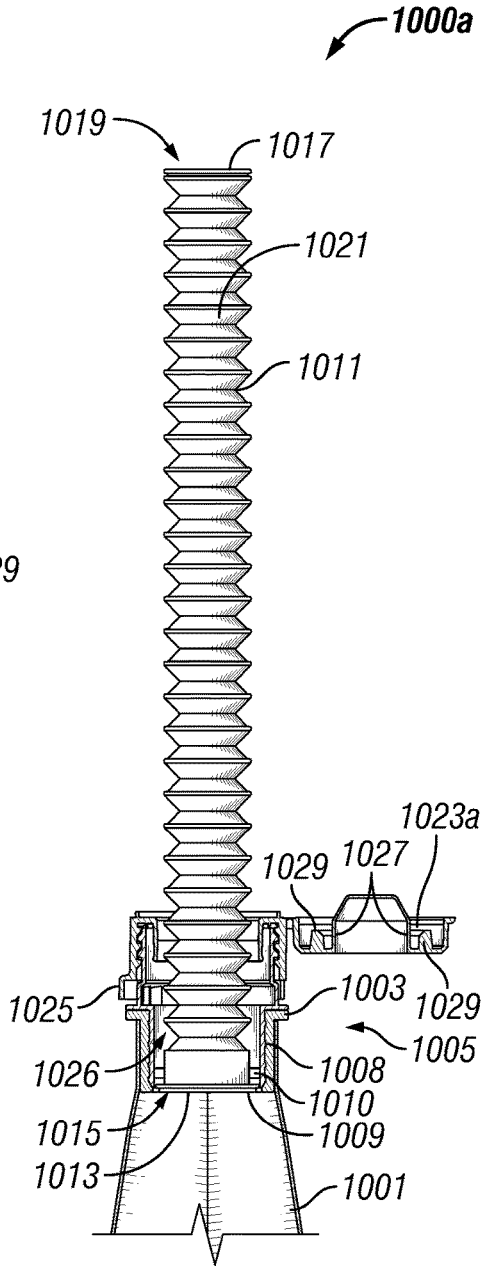
FIG. 15 is a cross-sectional view of a one-piece embodiment of the pouring spout fitment of FIG. 12.

FIG. 15 illustrates an alternate embodiment of the pouring spout fitment 1000, 1000*a*. This embodiment includes a hollow rigid member 1005, a hollow canoe portion 1003, a rail grabber portion 1025, and an extendible spout 1011 as described above. However, in this embodiment the lid 1023*a* is integral with the remainder of the fitment 1000*a*. In this embodiment, the lid 1023*a* may be formed in a single injection molding step, and is hingedly connected to the hollow rigid member 1005, rail grabber portion 1025, and hollow canoe portion 1003.

Figure 16:
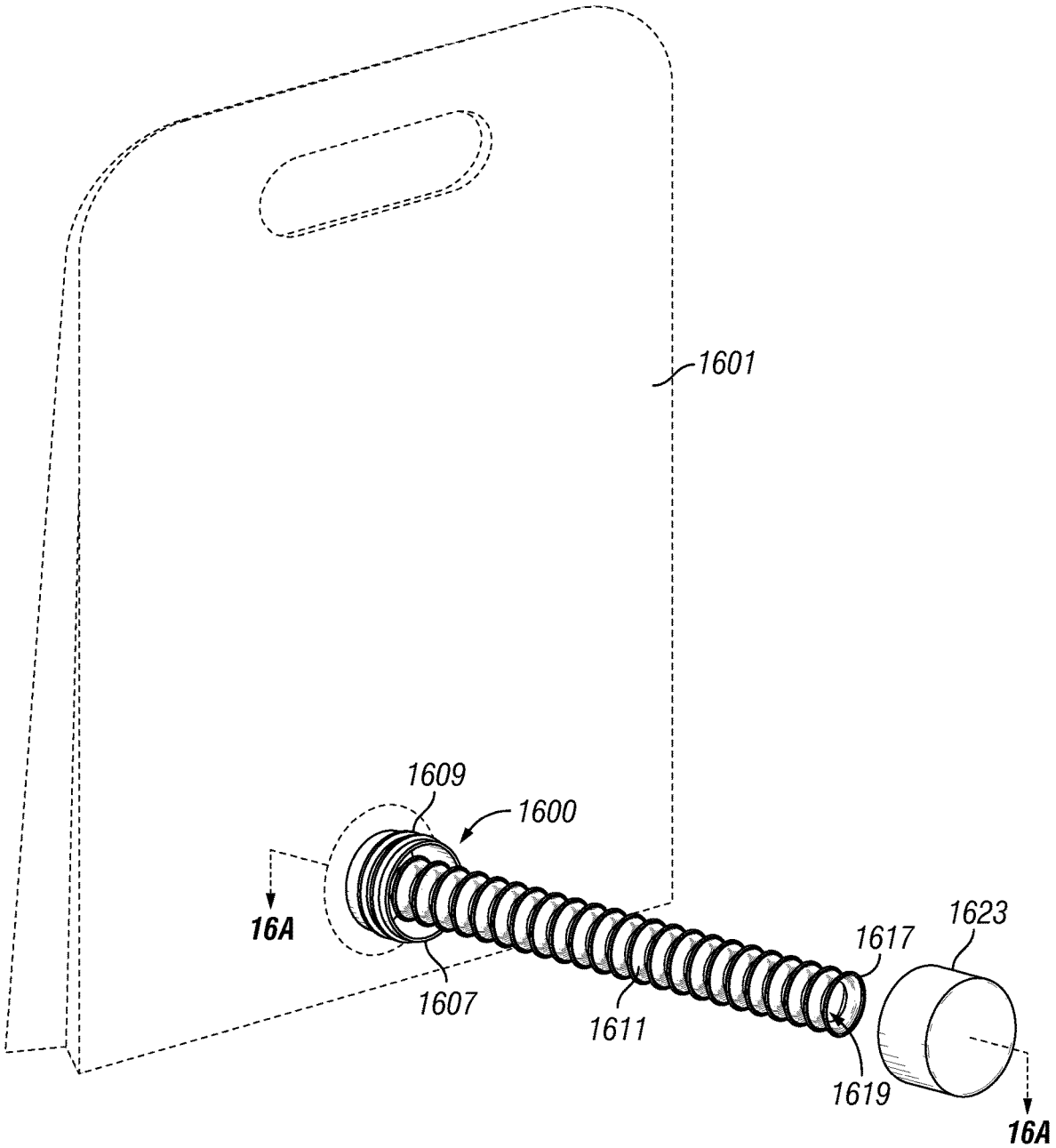
FIG. 16 is another embodiment of a pouring spout fitment and flexible container.
Figure 16A:
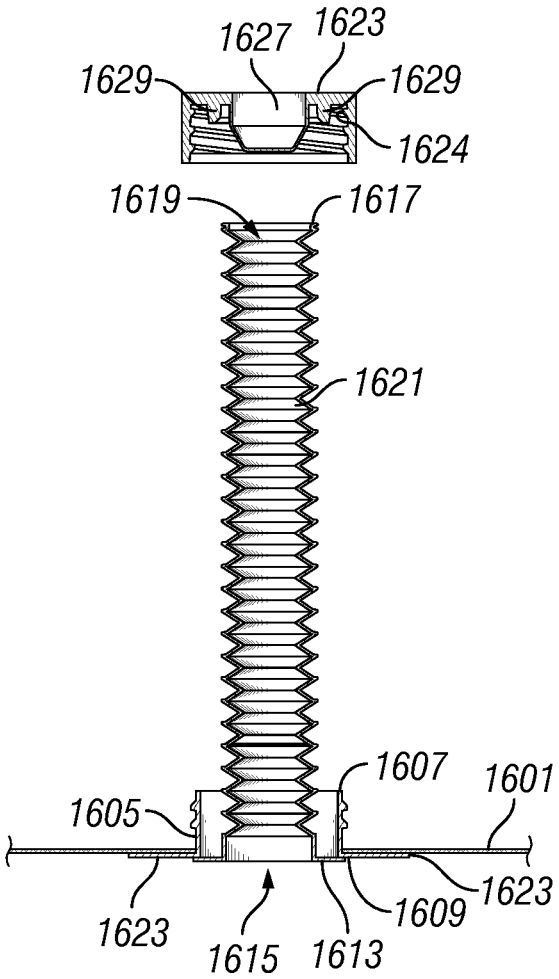
FIG. 16A is a cross-sectional view of the pouring spout fitment of FIG. 16.

FIGS. 16 and 16A illustrate a pouring spout fitment 1600 for a flexible container 1601. FIG. 16A depicts a cross-sectional view of the pouring spout fitment 1600 of FIG. 16, taken along line A-A. The pouring spout fitment 1600 includes a hollow rigid member 1605 having a top end 1607 and a bottom end 1609. The pouring spout fitment 1600 further includes an extendible spout 1611 that is at least partially disposed in and connected to the hollow rigid member 1605. In this embodiment, the extendible spout is connected to the bottom end 1609 of the hollow rigid member. The extendible spout 1611 includes a proximal end 1613 and a proximal opening 1615, a distal end 1617 and a distal opening 1619, and a discharge passage 1621. The proximal end 1613 is connected to the hollow rigid member 1605, the distal end 1617 is configured to extend from and retract at least partially into the hollow rigid member 1605, and the discharge passage 1621 extends from the proximal opening 1615 to the distal opening 1619. The extendible spout is configured to extend between an extended position, wherein the distal end 1617 extends from top end 1607 of the hollow rigid member 1605, and a retracted position, wherein the distal end 1617 retracts at least partially into the hollow rigid member 1605. The extendible spout 1611 is configured to dispense the pourable material from the flexible package 1601 through the distal opening 1619 when the hollow canoe portion 1603 is attached to the inner surface of the flexible package 1601. FIGS. 16 and 16A illustrate the extendible spout in an extended configuration.

The pouring spout fitment 1600 further includes a removable lid 1623, which is attached to the top end 1607 of the hollow rigid member 1605 by threads 1624.

It should be apparent that the foregoing relates only to certain embodiments of the present disclosure and that numerous changes and modifications may be made herein without departing from the spirit and the scope of the disclosure as defined by the appended claims and equivalents thereof.

What is claimed is:

1. A pouring spout fitment for a flexible container comprising:

(1) a hollow canoe portion having an outer surface and an inner surface defining a passage extending through the body, wherein the canoe is configured to be attached to an inner surface of the flexible container;

(2) a hollow rigid member at least partially disposed within the hollow canoe portion, the hollow rigid member comprising a top end having a discharge opening and a base end, the base end extending from the hollow canoe portion toward the flexible container;

(3) an extendible spout at least partially disposed in the hollow rigid member and connected to the hollow rigid member, the extendible spout comprising:

a proximal end and a proximal opening, the proximal end connected to the base end of the hollow rigid member, a distal end and a distal opening, the distal end configured to extend from and retract at least partially into the hollow rigid member, and a discharge passage that extends from the proximal opening to the distal opening, wherein the extendible spout is configured to dispense a pourable material from the flexible container through the distal opening when the hollow canoe portion is attached to the inner surface of the flexible container; and (4) a removable lid which is selectively positionable between a closed position, wherein the removable lid covers the discharge opening of the hollow rigid member and the distal opening of the extendible spout and an open position, wherein the removable lid allows a pourable material to pass through the discharge opening of the hollow rigid member and the distal opening of the extendible spout, wherein the removable lid further comprises:

a first sealing flange which engages with the top end of the hollow rigid member to form a seal between the removable lid in the closed position and the hollow rigid member; and a second sealing flange which engages with the distal end of the extendible spout to form a seal between the removable lid in the closed position and the extendible spout.

2. The pouring spout fitment of claim 1, wherein the top end of the hollow rigid member is attached to the canoe portion.

3. The pouring spout fitment of claim 1, further comprising a rail grabber portion attached to the hollow canoe portion and surrounding at least a portion of the hollow rigid member.

4. The pouring spout fitment of claim 1, wherein the flexible container comprises a hollow friction fitting, and wherein the hollow canoe portion is configured to be attached to the inner surface of the hollow friction fitting.

5. The pouring spout fitment of claim 1, wherein the hollow canoe portion and the hollow rigid member form a single integral fitment.

6. A material container comprising the pouring spout fitment of claim 1 disposed within an opening in the flexible container.

7. The pouring spout fitment of claim 1, further comprising a handling portion comprising an outer ring configured to removably attach the handling portion about a dispensing opening of the flexible container and an inner ring defining a circular aperture within the handling portion.

8. The pouring spout fitment of claim 7, wherein the handling portion and hollow rigid member are permanently affixed to one another.

9. The pouring spout fitment of claim 7, wherein the hollow rigid member is slideably disposed within the circular aperture and selectively positionable between a recessed position in which the top end is proximate the handling portion and the base end extends away from the handling portion and toward the container and, alternatively, an extended position in which the top end extends away from the handling portion and the container and the base end is substantially flush with either (i) the dispensing opening of the container or (ii) the inner ring of the handling portion, wherein the top end comprises a first engaging element for engaging at least a portion of the inner ring of the handling portion and preventing the top end of the hollow rigid member from moving through the handling portion into the container when the hollow rigid member is in the recessed position, and wherein the base end comprises a second engaging element for engaging at least a portion of the inner ring of the handling portion and fixing the hollow rigid member to the handling portion when the hollow rigid member is in the extended position.

10. The pouring spout fitment of claim 1, wherein the extendible spout comprises a corrugated portion.

11. The pouring spout fitment system of claim 1, wherein the extendible spout is flexible.

12. The pouring spout fitment of claim 1, wherein the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member.

13. The pouring spout fitment of claim 1, wherein the extendible spout, when in a fully retracted position, has a length that is about equal to or less than the length of the hollow rigid member.

14. The pouring spout fitment of claim 1, further comprising a pull tab at the distal end of the extendible spout.

15. The pouring spout fitment of claim 1, further comprising a removable safety seal at the distal end of the extendible spout.

16. The pouring spout fitment of claim 1, further comprising a seal plug at the distal end of the extendible spout.

* * * * *